US007828043B2

(12) United States Patent
Foley et al.

(10) Patent No.: US 7,828,043 B2
(45) Date of Patent: Nov. 9, 2010

(54) NON-INVASIVE REAL-TIME LEVEL SENSING AND FEEDBACK SYSTEM FOR THE PRECISION SAND CASTING PROCESS

(75) Inventors: Brian M. Foley, Worcester, MA (US); Scott W. Biederman, New Boston, NH (US); Reinhold Ludwig, Paxton, MA (US); Sergey Makarov, Holden, MA (US)

(73) Assignee: GM Global Technology Operations, Inc., Detroit, MI (US)

( * ) Notice: Subject to any disclaimer, the term of this patent is extended or adjusted under 35 U.S.C. 154(b) by 475 days.

(21) Appl. No.: 11/869,020

(22) Filed: Oct. 9, 2007

(65) Prior Publication Data

US 2009/0090482 A1 Apr. 9, 2009

(51) Int. Cl.
*B22D 2/00* (2006.01)
*B22D 11/18* (2006.01)
*B22D 46/00* (2006.01)

(52) U.S. Cl. ..... 164/457; 164/151.3; 164/155.2; 164/450.5

(58) Field of Classification Search ..... 164/4.1, 164/451, 453, 151.3, 155.2, 450.5, 457
See application file for complete search history.

(56) References Cited

U.S. PATENT DOCUMENTS

| | | | | |
|---|---|---|---|---|
| 4,441,541 | A * | 4/1984 | Block | 164/453 |
| 4,786,869 | A * | 11/1988 | Kanai et al. | 324/207.18 |
| 5,034,621 | A * | 7/1991 | Groves et al. | 307/117 |
| 2006/0011322 | A1 * | 1/2006 | Dussud et al. | 164/457 |

FOREIGN PATENT DOCUMENTS

DE 10 2005 010 351 A1 8/2006

OTHER PUBLICATIONS

Brian M. Foley; Sean Hallinan; Hans Erik Jensen—Non-Invasive Metal Detection, (Thesis), Project No. SJB-3A06, Apr. 20, 2007.

* cited by examiner

*Primary Examiner*—Kuang Lin
(74) *Attorney, Agent, or Firm*—Fraser Clemens Martin & Miller LLC; J. Douglas Miller

(57) ABSTRACT

A level sensing system and method for determining the level of a conductive material in a casting mold are disclosed, wherein the level sensing system a drive circuit and an inductive component disposed adjacent to the casting mold, and a position of the conductive material in the casting mold may be determined by a change in an electrical characteristic of the drive circuit.

16 Claims, 2 Drawing Sheets

NON-INVASIVE REAL-TIME LEVEL SENSING AND FEEDBACK SYSTEM FOR THE PRECISION SAND CASTING PROCESS

FIELD OF THE INVENTION

This invention relates to a method and system for a casting process, and more particularly, to a level sensing system and method for determining the position of a conductive material in a mold cavity.

BACKGROUND OF THE INVENTION

Casting processes are frequently used to produce cast articles having a complex geometry. Precision sand casting is one such casting process used for producing cast articles having complex geometries. The casting articles typically require optimized mechanical properties and dimensional precision. Castings formed using precision sand casting are formed by pouring a molten material, such as molten metal, into a mold cavity formed from sand. The mold cavity is formed by placing a duplicate of the desired casting, referred to as a pattern, into a casting mold. The casting mold is then filled with packed sand around the pattern. The casting mold is closed around the pattern and then reopened. The pattern is removed to result in a mold cavity being formed in the packed sand having the shape of the pattern. Once the sand is allowed to dry, the casting mold is prepared to receive the molten metal.

Cast articles having transitions from a thick portion to a thin portion, extensive horizontal or flat surfaces, and sharp corners, are susceptible to defects. Such defects are formed in the casting due to a turbulent flow of molten metal when the mold cavity is filled, and an uneven distribution of the molten metal through the mold cavity. To militate against turbulent flow, the flow-rate of the molten metal into the mold cavity may be regulated. For example, as the volume of the mold cavity increases, the flow-rate of the molten metal may be adjusted to militate against the solidification of the metal in the mold, thereby impeding the flow of additional molten metal to the mold cavity. Conversely, if a molten material is caused to flow into the mold cavity at a high flow rate to fill a large cavity and the volume of the cavity then decreases, a back-pressure may be created within the mold. It is understood that the mold fill rate may be constant even if the mold cross-section varies.

Because the mold cavity is formed by the packed sand and enclosed in the casting mold, it may be difficult to determine a location of the molten material within the mold at a given time. Furthermore, parameters such as a flow-rate, a melt temperature, a pressure tightness, and atmospheric pressure may vary from one casting operation to the next. Current sand casting processes use thermocouples or contact probes in an attempt to monitor the position of a molten metal front. The thermocouples or probes must be disposed within the casting mold and in contact with the casting, which may influence the quality of the casting.

It would be desirable to develop a non-invasive, real-time, molten metal level sensing system and method for determining the level of a molten metal within the mold, wherein contact with the molten metal or the casting mold is militated against.

SUMMARY OF THE INVENTION

Concordant and consistent with the present invention, a non-invasive, real-time, molten metal level sensing system and method for determining the level of a molten metal within the mold, wherein contact with the molten metal or the casting mold is militated against, has surprisingly been discovered.

In one embodiment a level sensing system comprises a drive circuit and an inductive component, coupled to the drive circuit, wherein a magnetic field generated by the inductive component causes a change in an electrical characteristic of the drive circuit when a conductive material is caused to flow through the magnetic field.

In another embodiment a level sensing system for a casting mold comprising: a casting mold forming a mold cavity for receiving a conductive material therein; a drive circuit; and an inductive component coupled to the drive circuit, wherein a magnetic field generated by the inductive component causes a change in an electrical characteristic of the drive circuit when a conductive material is caused to flow through the magnetic field.

The invention also provides methods of determining the position of a conductive material in a casting mold.

One method comprises the steps of: providing a casting mold forming a mold cavity for receiving a conductive material therein; providing a drive circuit adapted to generate a magnetic field in the mold cavity disposed adjacent to said casting mold, wherein a flow of the conductive material through the magnetic field causes a change to an electrical characteristic of the resonant drive circuit; introducing a conductive material into the mold cavity of the casting mold; and measuring a change in electrical characteristics of the resonant drive circuit as the conductive material fills the mold cavity, the change in electrical characteristics indicating a position of the conductive material, within the mold cavity.

BRIEF DESCRIPTION OF THE DRAWINGS

The above, as well as other advantages of the present invention, will become readily apparent to those skilled in the art from the following detailed description of embodiments of the invention when considered in the light of the accompanying drawings in which.

DETAILED DESCRIPTION OF THE EMBODIMENTS OF THE INVENTION

The following detailed description and appended drawings describe and illustrate various embodiments of the invention. The description and drawings serve to enable one skilled in the art to make and use the invention, and are not intended to limit the scope of the invention in any manner. In respect of the methods disclosed, the steps presented are exemplary in nature, and thus, the order of the steps is not necessary or critical.

Figure 1:
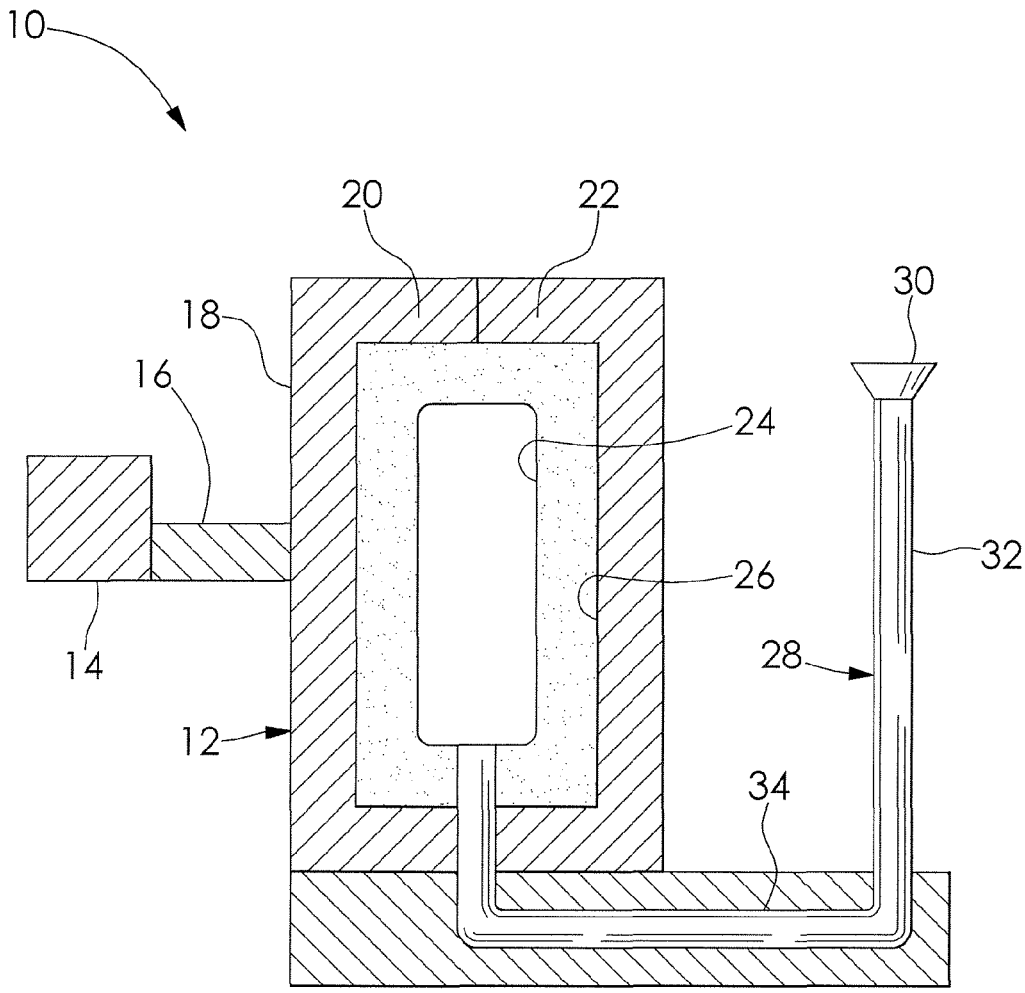
FIG. 1 is a sectional view of a level sensing system and mold according to an embodiment of the invention.

FIG. 1 illustrates a level sensing system 10 according to an embodiment of the invention. The level sensing system 10 includes a drive circuit 14 disposed adjacent a casting mold 12. It is understood that a plurality of drive circuits 14 may be disposed adjacent the mold casting mold 12 of the level sensing system 10. The drive circuits 14 may be disposed adjacent any portion of the casting mold 12, as desired.

In the embodiment shown in FIG. 1, the drive circuit 14 is an LC oscillator circuit including an inductive component 16, also referred to as an electromagnetic sensor. The inductive component 16 is disposed adjacent an outer wall 18 of the casting mold 12. It is understood that the drive circuit 14 may also be an automatic gain control circuit including an LC tank and a tuner circuit including an LC tank, for example.

Figure 2:
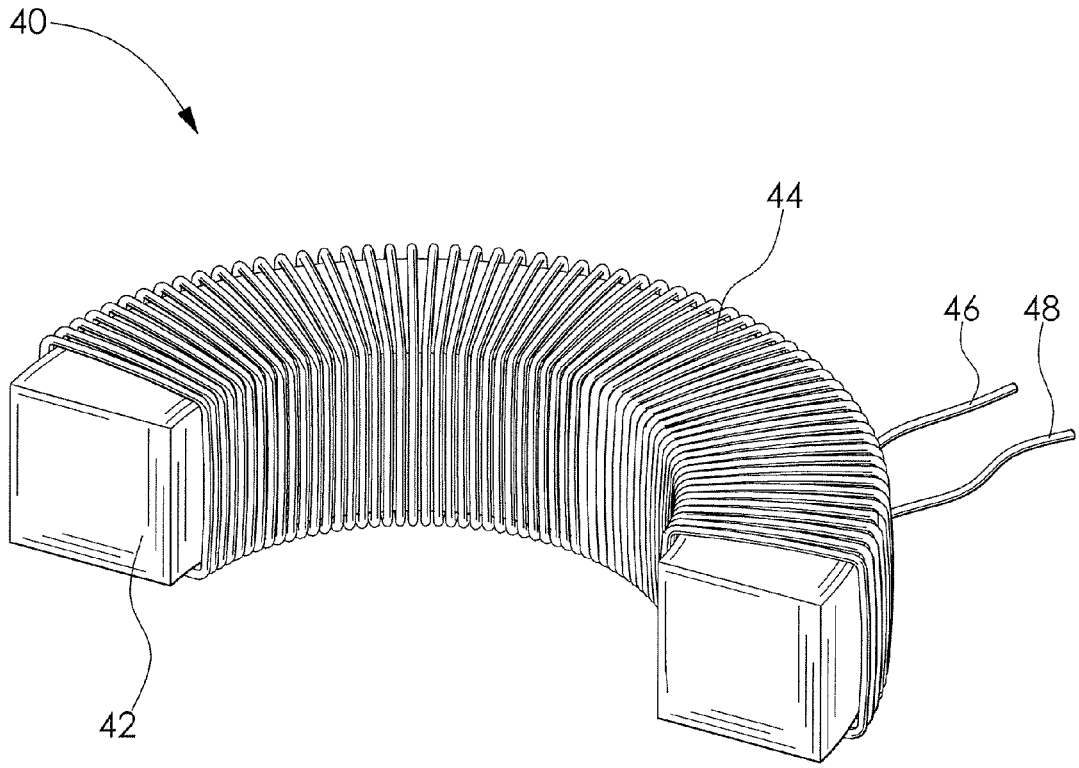
FIG. 2 is a perspective view of a c-shaped electromagnetic coil according to the present invention.

As more clearly shown in FIG. 2, the inductive component 16 of the drive circuit 14 is an electromagnetic coil 40 having a c-shape. Leads 46, 48 of the electromagnetic coil 40 are in electrical communication with the drive circuit 14. The electromagnetic coil 40 is formed from a ferrite core 42 having a winding of magnetic wire 44 with a desired number of turns. It is understood that the inductive component 16 may have other shapes such as a cylindrical coil, as desired. Further, the inductive component 16 may be wound with any number of turns of magnetic wire 44 to obtain a desired electrical characteristic of the inductive component 16. An aperture, a magnetic permeability, the number of turns of magnetic wire 44, the gauge of magnetic wire 44, and the shape of the inductive component 16 may be selectively varied to achieve the desired electrical characteristic.

The casting mold 12 includes a first half 20 and a second half 22. Each of the first half 20 and the second half 22 include an inner wall 26 which defines a mold cavity 24 for receiving a molten conductive material (not shown). In the embodiment shown, the molten conductive material is a molten metal such as aluminum, for example. The casting mold 12 includes a gate system 28 in fluid communication with the mold cavity 24. In the embodiment shown, the gate system 28 includes a pouring cup 30, a downsprue 32, and a runner 34. The gate system 28 may further include a means for regulating a flow of conductive material, such as a valve, a slide gate, and an electromagnetic pump. The mold cavity 24 may be formed from any conventional, non-metal material such as natural sand and synthetic sand, for example. The mold cavity 24 may be any size or shape as desired to produce a desired casting. The mold cavity may further include cores of any size and shape as desired.

In use, the conductive material is poured into the pouring cup 30 of the gate system 28. The conductive material flows through the downsprue 32, through the runner 34, and into the mold cavity 24. As the conductive material fills the mold cavity 24, the conductive material moves into a magnetic field of influence emanating from the inductive component 16 of the drive circuit 14 into the mold cavity 24. It is understood that the magnetic field of influence may be calculated by any conventional means, such as using a linear-motion table to move a sheet of aluminum into the magnetic field at a constant rate and recording a linear range at which the metal affects the electrical characteristics of the drive circuit 14, for example. The magnetic field of the inductive component 16 induces eddy currents in the conductive material. The eddy currents create magnetic fields which oppose the applied magnetic field of the inductive component 16. The interaction of the eddy currents within the conductive material and the applied magnetic field of the inductive component 16 affect electrical characteristics of the inductive component 16 and the drive circuit 14. The electrical characteristic may be any characteristic such as a voltage, a frequency, a resistive reactance, and an inductive reactance, for example. The affected electrical characteristic is then measured by an operator of the system 10, using any conventional electrical measurement device, such as an oscilloscope, for example.

Where the drive circuit 14 is an automatic gain control circuit, the drive circuit 14 will maintain a fixed frequency. A field of influence is calculated for the magnetic field generated by the drive circuit 14 and inductive component 16. When the conductive material enters the magnetic field of influence, the inductive component 16 exhibits a change in voltage, such as a decrease in voltage across the inductive component 16. As the conductive material moves through the applied magnetic field generated by the drive circuit 14, the voltage across the inductive component 16 continues to decrease until the conductive material is beyond the magnetic field of influence. Since the position of the inductive component 16 relative to the mold cavity 24 is known, the voltage drop across the inductive component 16 is measured and used to determine the position of the conductive material in the mold cavity 24. For example, through experimentation, it has been determined that where the field of influence of the magnetic field is 7 inches, an initial drop in voltage measured across the inductive component 16 indicates the position of the conductive material is 3.5 inches from the center of the inductive component 16.

Where the drive circuit 14 functions as a tuning circuit, the frequency of the alternating magnetic field generated by the drive circuit 14 will shift as the conductive material moves within the applied magnetic field. Measurement equipment, such as an oscilloscope, in electrical communication with the drive circuit 14 is used to monitor the electrical characteristics of the drive circuit 14. A field of influence is calculated for the magnetic field generated by the drive circuit 14 and inductive component 16. By knowing the position of the inductive component 16 in relation to the mold cavity 24, and by monitoring the frequency shift of the drive circuit 14 as the conductive material enters the magnetic field of influence, the operator may determine the position of the conductive material in the mold cavity 24.

By determining the level of the conductive material in the casting mold 12 with the material level sensing system 10 without contacting the flow of conductive material or the casting mold 12, the operator may regulate the flow rate of the conductive material through the casting mold 12. It is understood that a controller may be adapted to regulate the flow rate of the conductive material in response to changes in electrical characteristics of the drive circuit 14.

The non-invasive, real-time regulation of the flow of conductive material militates against turbulent flow, thereby increasing the quality of the castings, producing even fill distribution, and minimizing an amount of scrap generated by damaged castings in scrap parts.

From the foregoing description, one ordinarily skilled in the art can easily ascertain the essential characteristics of this invention and, without departing from the spirit and scope thereof, make various changes and modifications to the invention to adapt it to various usages and conditions.

What is claimed is:

1. A level sensing system comprising:

a casting mold forming a mold cavity for receiving a conductive material therein;

a drive circuit; and an inductive component coupled to the drive circuit and disposed adjacent the casting mold, wherein the inductive component is an electromagnetic coil having a generally C-shaped core with an aperture formed therein, and wherein a magnetic field generated by the inductive component causes a change in an electrical characteristic of the drive circuit when the conductive material is caused to flow through the magnetic field.

2. A level sensing system according to claim 1, wherein a desired electrical characteristic of the drive circuit is obtained by varying at least one of a size of the aperture formed in the inductive component, a magnetic permeability of the inductive component, a number of turns of magnetic wire forming the inductive component, and a shape of the inductive component.

3. A level sensing system according to claim 1, wherein the conductive material is a molten metal.

4. A level sensing system according to claim 1, wherein the drive circuit is an LC oscillator circuit.

5. A level sensing system according to claim 1, wherein the drive circuit is an automatic gain control circuit including an LC tank.

6. A level sensing system according to claim 1, wherein the drive circuit is a tuner circuit including an LC tank.

7. The level sensing system according to claim 1, wherein the change in the electrical characteristic is a voltage change across the inductive component.

8. The level sensing system according to claim 1, wherein the change in the electrical characteristic is a frequency shift in magnetic field generated by the drive circuit.

9. A level sensing system for a casting mold comprising:

a casting mold forming a mold cavity for receiving a conductive material therein;

a drive circuit; and an inductive component coupled to the drive circuit and disposed adjacent the casting mold, wherein the inductive component is an electromagnetic coil having a generally C-shaped core with an aperture formed therein, the aperture interposed between at least a portion of the core and the casting mold, and wherein a magnetic field generated by the inductive component causes a change in an electrical characteristic of the drive circuit when a conductive material is caused to flow through the magnetic field.

10. A level sensing system according to claim 9, wherein a desired electrical characteristic of the drive circuit is obtained by varying at least one of size a size of the aperture formed in the inductive component, a magnetic permeability of the inductive component, a number of turns of magnetic wire forming the inductive component, and a shape of the inductive component.

11. A level sensing system according to claim 9, wherein the drive circuit is one of an LC oscillator circuit, an automatic gain circuit, including an LC tank, and a tuner circuit, including an LC tank.

12. The level sensing system according to claim 9, wherein the change in the electrical characteristic is a voltage change across the inductive component.

13. The level sensing system according to claim 9, wherein the change in the electrical characteristic is a frequency shift in magnetic field generated by the drive circuit.

14. The level sensing system according to claim 9, further comprising a controller for regulating the flow of the conductive material, wherein the controller is adapted to respond to changes in the electrical characteristics of the drive circuit.

15. A method of determining the position of a conductive material in a casting mold, the method comprising the steps of:

providing a casting mold forming a mold cavity for receiving a conductive material therein;

providing an inductive component disposed adjacent the casting mold a, wherein the inductive component is an electromagnetic coil having a C-shaped core with an aperture formed therein;

providing a drive circuit in electrical communication with the inductive component to cause to the inductive component to generate a magnetic field in the mold cavity, wherein a flow of the conductive material through the magnetic field causes a change in an electrical characteristic of the drive circuit;

introducing a conductive material into the mold cavity of the casting mold; and measuring a change in an electrical characteristic of the drive circuit as the conductive material fills the mold cavity, the change in the electrical characteristic indicating a position of the conductive material within the mold cavity.

16. The method according to claim 15, wherein the change in the electrical characteristic is at least one of a voltage change across the inductive component and a frequency shift in the drive circuit.

* * * * *